US010534297B2

(12) United States Patent
Miura et al.

(10) Patent No.: US 10,534,297 B2
(45) Date of Patent: Jan. 14, 2020

(54) ELECTROPHOTOGRAPHIC ROTATABLE PRESSING MEMBER AND METHOD OF MANUFACTURING THE SAME, AND FIXING DEVICE

(71) Applicant: CANON KABUSHIKI KAISHA, Tokyo (JP)

(72) Inventors: Jun Miura, Kawasaki (JP); Yutaka Arai, Kawasaki (JP); Takeshi Suzuki, Yokohama (JP); Akeshi Asaka, Kashiwa (JP); Shigeaki Takada, Abiko (JP); Masaaki Takahashi, Yokohama (JP); Yo Imaizumi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/426,498

(22) Filed: May 30, 2019

(65) Prior Publication Data

US 2019/0278202 A1 Sep. 12, 2019

Related U.S. Application Data

(62) Division of application No. 15/926,028, filed on Mar. 20, 2018, now Pat. No. 10,353,330.

(30) Foreign Application Priority Data

Mar. 28, 2017 (JP) ..... 2017-063793

(51) Int. Cl.
*G03G 15/20* (2006.01)
*B05D 1/30* (2006.01)

(52) U.S. Cl.
CPC ..... *G03G 15/206* (2013.01); *B05D 1/30* (2013.01); *G03G 15/2057* (2013.01); *G03G 15/2064* (2013.01); *G03G 2215/2035* (2013.01)

(58) Field of Classification Search
CPC ..... G03G 15/206; G03G 15/2057; G03G 15/2064; G03G 2215/2035; G03G 2215/2051
See application file for complete search history.

(56) References Cited

U.S. PATENT DOCUMENTS 7,974,563 B2 7/2011 Sakai et al.
8,005,413 B2 8/2011 Sakakibara et al.
8,224,223 B2 7/2012 Sakakibara et al.
(Continued)

FOREIGN PATENT DOCUMENTS

WO 2016/009527 A1 1/2016

*Primary Examiner* — Sandra Brase
(74) *Attorney, Agent, or Firm* — Venable LLP

(57) ABSTRACT

Provided is an electrophotographic rotatable pressing member having further durability. The electrophotographic rotatable pressing member includes: a substrate; and an elastic layer formed on the substrate, the elastic layer containing a silicone rubber and a needle-shaped filler dispersed in the silicone rubber and having hollow parts, wherein, when cutting the elastic layer along a cross section including a center axis of the substrate in a longitudinal direction of the electrophotographic rotatable pressing member, and a total of each sectional area of the hollow parts in a unit area $A_2$ of a cross-sectional surface is defined as $A_1$, a standard deviation of an area ratio $A_1/A_2$ is 0.08 or less.

8 Claims, 6 Drawing Sheets

(56) References Cited

U.S. PATENT DOCUMENTS

| | | | | |
|---|---|---|---|---|
| 8,369,763 | B2 | 2/2013 | Sakakibara et al. | |
| 8,401,450 | B2 | 3/2013 | Sekihara et al. | |
| 8,626,046 | B2 | 1/2014 | Sekihara et al. | |
| 9,063,491 | B2 | 6/2015 | Matsunaka et al. | |
| 9,086,664 | B2 | 7/2015 | Matsunaka et al. | |
| 9,134,663 | B2 | 9/2015 | Matsunaka et al. | |
| 9,134,664 | B2 | 9/2015 | Miura et al. | |
| 9,152,110 | B2 | 10/2015 | Miura et al. | |
| 9,268,273 | B2 | 2/2016 | Miyahara et al. | |
| 9,304,461 | B2 | 4/2016 | Miura et al. | |
| 9,335,690 | B2 | 5/2016 | Asaka et al. | |
| 9,348,282 | B2 | 5/2016 | Tamura et al. | |
| 9,348,283 | B2 | 5/2016 | Takada et al. | |
| 9,354,571 | B2 | 5/2016 | Miura et al. | |
| 9,367,009 | B2 | 6/2016 | Akiyama et al. | |
| 9,417,575 | B2 | 8/2016 | Miura et al. | |
| 10,261,429 | B2 | 4/2019 | Asaka et al. | |
| 2014/0301763 | A1 | 10/2014 | Miura et al. | |
| 2015/0071690 | A1 | 3/2015 | Miyahara et al. | |
| 2015/0160596 | A1* | 6/2015 | Asaka ..... | G03G 15/206 399/333 |
| 2016/0018766 | A1 | 1/2016 | Akiyama et al. | |
| 2016/0018767 | A1 | 1/2016 | Takada et al. | |
| 2016/0018771 | A1* | 1/2016 | Arai ..... | G03G 15/206 399/333 |
| 2016/0018772 | A1 | 1/2016 | Miura et al. | |

* cited by examiner

ELECTROPHOTOGRAPHIC ROTATABLE PRESSING MEMBER AND METHOD OF MANUFACTURING THE SAME, AND FIXING DEVICE

CROSS-REFERENCE TO RELATED APPLICATIONS

This application is a divisional application of U.S. patent application Ser. No. 15/926,028, filed Mar. 20, 2018, which claims the benefit of Japanese Patent Application No. 2017-063793, filed on Mar. 28, 2017. Both prior applications are hereby incorporated by reference herein in their entirety.

BACKGROUND OF THE INVENTION

Field of the Invention

The present invention relates to an electrophotographic rotatable pressing member to be used in a fixing device configured to nip, convey, and heat a recording material, and a method of manufacturing the electrophotographic rotatable pressing member. The present invention also relates to a fixing device.

Description of the Related Art

In an electrophotographic image forming apparatus, a heat fixing device is used as a device configured to fix an unfixed toner image formed on a recording material onto the recording material. The heat fixing device includes a heating member and an electrophotographic rotatable pressing member arranged so as to be opposed to the heating member. The heat fixing device is configured to convey the recording material by rotation of the heating member and the electrophotographic rotatable pressing member while fixing a toner onto the recording material with heat from the heating member and a pressure caused by pressure contact between the heating member and the electrophotographic rotatable pressing member.

The electrophotographic rotatable pressing member includes a substrate and an elastic layer. The substrate gives stiffness sufficient for withstanding the pressure contact with the heating member. The elastic layer gives elasticity required for forming a nip portion. Further, a surface layer made of a fluorine resin for giving toner releasability may be formed on the elastic layer.

In International Publication No. WO2016/009527, there is described an invention which has an object to provide a pressurizing member capable of achieving, at a high level, both reduction in warm-up time and suppression of generation of creases extending in a circumferential direction. In this case, the warm-up time refers to a time period for raising the temperature of a nip portion to a temperature required for fixing a toner in order to reduce power consumption in a fixing device.

In International Publication No. WO2016/009527, there is described that the above-mentioned object can be achieved by the following configuration. That is, there is provided a pressurizing member including a substrate, an elastic layer formed on an outer side of the substrate, and a surface layer containing a fluorine resin formed on the elastic layer. The surface layer is fixed to the elastic layer under a state of being extended in a longitudinal direction, and the elastic layer has a hollow part ratio of from 20 vol % to 60 vol % or less. The pressurizing member has E(MD)/E(ND) being larger than 1.0, where E(ND) represents an elastic modulus of the elastic layer in a thickness direction, and E(MD) represents an elastic modulus of the elastic layer in a longitudinal direction. Further, there is disclosed that the above-mentioned physical properties are obtained by the elastic layer in which hollow parts are dispersed, the hollow parts being formed by evaporating water in a silicone rubber in which needle-shaped fillers are arranged in the longitudinal direction and water is dispersed.

SUMMARY OF THE INVENTION

One embodiment of the present invention is directed to providing an electrophotographic rotatable pressing member being capable of reducing the warm-up time and having further durability, and a method of manufacturing the electrophotographic rotatable pressing member.

Further, another embodiment of the present invention is directed to providing a fixing device capable of stably providing a high-quality electrophotographic image. According to one embodiment of the present invention, there is provided an electrophotographic rotatable pressing member, including: a substrate; and an elastic layer formed on the substrate, the elastic layer containing a silicone rubber and a needle-shaped filler dispersed in the silicone rubber, and having hollow parts, when cutting the elastic layer along a cross section including a center axis of the substrate in a longitudinal direction of the electrophotographic rotatable pressing member, and a total of each sectional area of the hollow parts in a unit area $A_2$ of a cross-sectional surface is defined as $A_1$, a standard deviation of an area ratio $A_1/A_2$ is 0.08 or less.

According to another embodiment of the present invention, there is provided a method of manufacturing an electrophotographic rotatable pressing member, the electrophotographic rotatable pressing member including: a substrate; and an elastic layer formed on the substrate, the elastic layer containing a silicone rubber and a needle-shaped filler dispersed in the silicone rubber and having hollow parts, the method including: dispersing the needle-shaped filler and a water-containing gel in a liquid silicone rubber to obtain an emulsion-like liquid composition; filling the emulsion-like liquid composition into a cavity formed between an outer peripheral surface of the substrate and an inner peripheral surface of a tubular mold, the substrate being held by a substrate-holder arranged at each end of the tubular mold; crosslinking and curing the liquid silicone rubber by heating without causing the emulsion-like liquid composition in the cavity to flow, to thereby obtain a cured product; and removing water from the cured product.

According to yet another embodiment of the present invention, there is provided a fixing device, including: an electrophotographic rotatable pressing member of the present invention; and a heating member arranged so as to be opposed to the electrophotographic rotatable pressing member.

Further features of the present invention will become apparent from the following description of exemplary embodiments with reference to the attached drawings.

DESCRIPTION OF THE EMBODIMENTS

Figure 1:
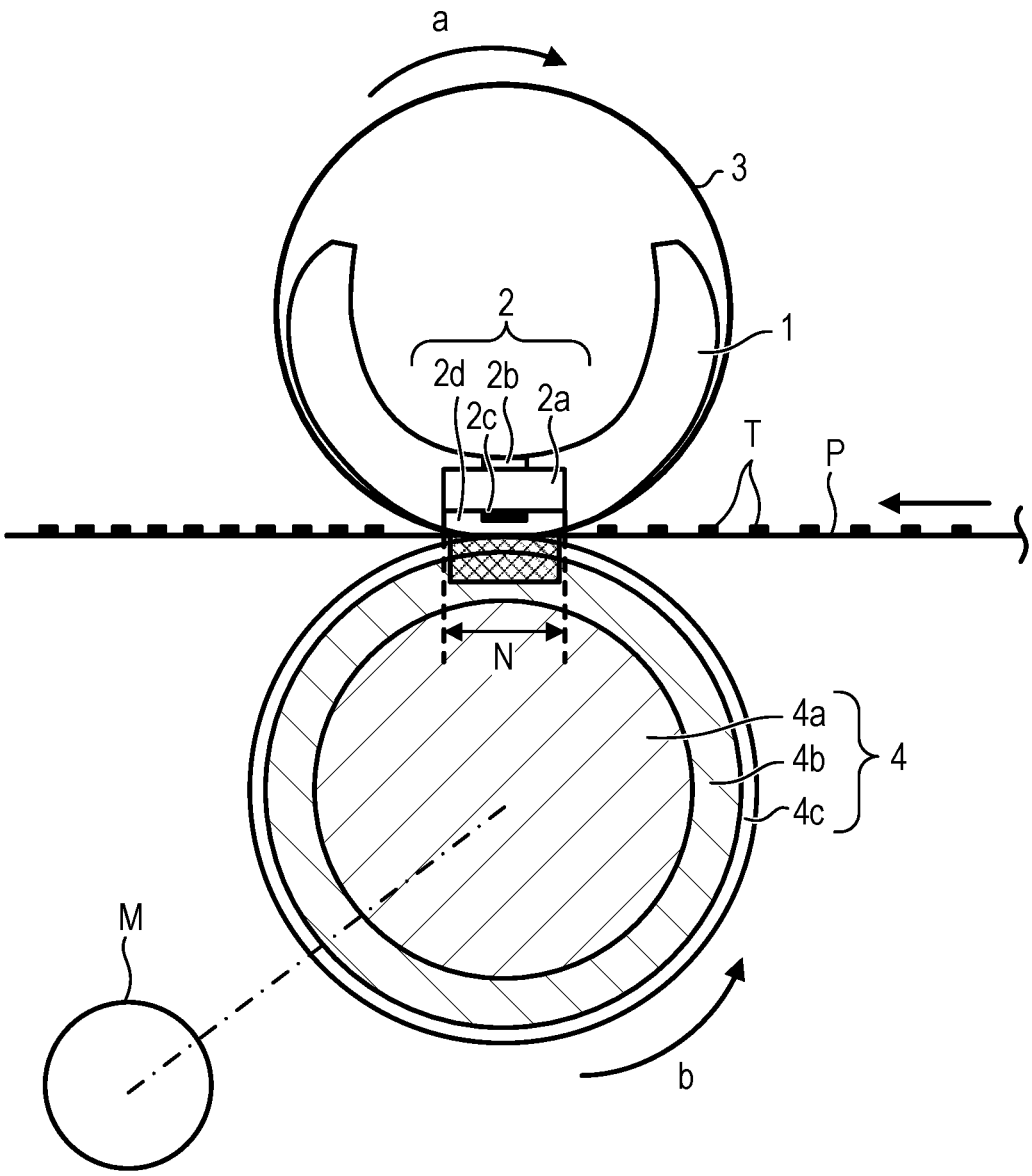
FIG. 1 is a sectional view for illustrating a fixing device according to one embodiment of the present invention.

The inventors of the present invention have confirmed presence or absence of durability at a higher level in an electrophotographic rotatable pressing member including the elastic layer disclosed in International Publication No. WO2016/009527, in which hollow parts formed by evaporating water in a silicone rubber containing needle-shaped fillers and dispersed water are dispersed. Specifically, the inventors of the present invention mounted the electrophotographic rotatable pressing member on a fixing device under a state in which a pressurizing force with respect to a heating member is set to be higher than a normal pressurizing force and subjected the fixing device to a test (hereinafter referred to as "severe durability test") in which a large number of electrophotographic images were continuously output. As a result, in the electrophotographic rotatable pressing member after being subjected to the severe durability test, there were cases in which some parts in which the hardness of a surface changed by 5% or more as compared to an initial value. Specifically, there were cases in which some parts in which a change ratio of the hardness as compared to an initial hardness was more than 5%.

The inventors of the present invention have made investigations of the reason that the hardness of the surface significantly changed in some parts of the pressurizing member disclosed in International Publication No. WO2016/009527 when the pressurizing member was subjected to the severe durability test. In the process of the investigations, observation was made on the elastic layer including the parts in which the hardness changed. As a result, it has been found that, in the parts in which the hardness changed, rubber skeletons supporting the hollow parts in the elastic layer were fractured, and further the fracture of the rubber skeletons was caused by the fact that the rubber skeletons were thinner than in the parts in which the rubber skeletons were not fractured.

In view of the foregoing, as the reason that there are parts including thin rubber skeletons and portions including thick rubber skeletons in the elastic layer, the inventors of the present invention have discussed the following. The method of manufacturing the pressurizing member disclosed in International Publication No. WO2016/009527 includes, as a production process of the elastic layer, a first step of filling an emulsified liquid silicon rubber mixture containing needle-shaped fillers and dispersed water into a mold for molding, then sealing the mold for molding, and heating and curing the liquid silicone rubber mixture in the mold for molding, and a second step of further heating the cured silicone rubber removed from the mold for molding to remove water finely dispersed in the cured silicone rubber, to thereby form a porous silicon rubber elastic layer.

In the first step, in the sealed mold for molding, the liquid silicone rubber mixture basically was not to flow, but actually, the liquid silicone rubber mixture leaked from the mold for molding in some cases. When the leakage of the liquid silicone rubber mixture from the mold for molding was recognized, the rubber skeletons in the elastic layer obtained through the second step significantly varied in thickness. In view of the foregoing, the inventors of the present invention have discussed the following. When the liquid silicone rubber mixture flows in the sealed mold for molding, the emulsified state of the liquid silicone rubber mixture is disrupted, and a water-containing gel in the liquid silicone rubber mixture is aggregated, resulting in variation in thickness of the rubber skeletons in the elastic layer to be obtained.

That is, an emulsified liquid has a thermodynamically unstable non-equilibrium system. Therefore, when the liquid silicone rubber mixture flows in the mold for molding at the time of being cured, disruption of the emulsified state proceeds due to a shearing force caused by the flow of the liquid silicone rubber mixture, and the water-containing gel dispersed in the liquid silicone rubber mixture is aggregated. When the liquid silicone rubber mixture is cured under a state in which the water-containing gel is aggregated, hollow parts are formed at positions where the water-containing gel was present in the elastic layer of the electrophotographic rotatable pressing member. Therefore, it is thought that the hollow parts are formed under a state of being aggregated to cause uneven distribution of the hollow parts in the elastic layer.

Based on the above-mentioned discussion, the inventors of the present invention have made an attempt to reduce the flow of the liquid silicone rubber mixture in the mold for molding at a higher level when the liquid silicone rubber mixture in the mold for molding is cured in the first step. Specifically, the inventors of the present invention have improved a sealing property of the mold for molding.

As a result, it has been found that, in the obtained electrophotographic rotatable pressing member, the hollow parts were remarkably uniformly distributed in the elastic layer, and a partial change in hardness is less liable to occur even after long-term use.

When the hollow parts are uniformly distributed in the elastic layer, the distances between the adjacent hollow parts become substantially uniform as compared to the case in which the distribution of the hollow parts is non-uniform. Therefore, it is considered that, when the elastic layer of the electrophotographic rotatable pressing member is pressurized in the fixing device, the number of portions in which large stress is concentrated becomes small, and thus fracture of the rubber skeletons forming the hollow parts is effectively suppressed.

Hitherto, in the case of considering durability of the electrophotographic rotatable pressing member, which is related to fracture of the rubber skeletons in the elastic layer in which the hollow parts are formed by evaporating water in a silicone rubber containing needle-shaped fillers and dispersed water, the uniformity of distribution of the hollow parts in the elastic layer has not been considered. In view of the foregoing, the inventors of the present invention used, as an indicator for representing the uniformity of distribution of the hollow parts, a standard deviation of a ratio (hereinafter sometimes simply referred to as "area ratio") of a total area of the hollow parts per unit area in a cut surface obtained by cutting the elastic layer of the electrophotographic rotatable pressing member along a cross section including a center axis of the substrate. As the standard deviation of the area ratio is smaller, the distribution of the hollow parts in the elastic layer is more uniform.

Now, a fixing device and an electrophotographic rotatable pressing member according to an embodiment of the present invention are specifically described.

(1) Fixing Device

FIG. 1 is a sectional view for illustrating a fixing device according to one embodiment of the present invention. The fixing device is a so-called on-demand type heat fixing device, and is a heat fixing device employing a film heating system using a ceramic heater as a heating source. An overview of the configuration of the on-demand type heat fixing device is described below as an example.

The fixing device according to the present invention is not limited to this embodiment, and is applicable also to a heat-roll type fixing device using a halogen heater as a heat source and to a fixing device employing an induction heating (IH) system configured to cause a member itself to generate heat by energizing a coil, which are generally used.

In FIG. 1, a film guide member 1 is a horizontally long film guide member having a substantially semi-circular arc tub shape in transverse section and having, as a width direction, a direction parallel to a longitudinal direction of an electrophotographic rotatable pressing member 4. A heater 2 is a horizontally long heater serving as a heating unit for a film 3 being a heating member and is accommodated and held in a groove formed substantially at the center of a lower surface of the film guide member 1 along the width direction. The film 3 has a tubular shape, which has an endless belt shape and is externally fitted loosely on the film guide member 1 having the heater 2 mounted thereon. That is, the heater 2 is arranged so as to be brought into contact with an inner peripheral surface of the film 3 having an endless belt shape.

The film guide member 1 is, for example, a molded product made of a heat-resistant resin such as polyphenylene sulfide (PPS) or a liquid crystal polymer.

The heater 2 has a configuration in which a heat generating resistor is arranged on a ceramic substrate. The heater 2 illustrated in FIG. 1 includes a horizontally long and thin plate-shaped heater substrate 2*a* made of alumina and a linear or thin band-shaped conductive heating element (heat generating resistor) 2*c* made of Ag/Pd, which is formed on a surface side (film sliding surface side) of the heater substrate 2*a* along a longitudinal direction thereof. The heater 2 also has a thin surface protective layer 2*d* made of glass configured to cover and protect the conductive heating element 2*c*. A thermistor (thermometric element) 2*b* is held in contact with a back surface side of the heater substrate 2*a*. The heater 2 can be controlled so as to rapidly raise a temperature by supplying electric power to the conductive heating element 2*c* and then keep a predetermined fixing temperature with an electric power control unit (not shown) including the thermometric element 2*b*. The fixing temperature is a target temperature of a fixing member surface and is appropriately set based on a printing speed, a sheet type, a fixing member configuration, and a toner type. A general fixing temperature is 150° C. or more and 200° C. or less.

The film 3 is, for example, a composite layer film in which a surface layer is applied to a surface of a base film. In order to reduce a heat capacity to improve a quick start property of a heating device, a total thickness of the film 3 is preferably set to be 500 μm or less.

As a material for the base film, there may be used: resins, such as polyimide (PI), polyamide-imide (PAI), polyether ether ketone (PEEK), and polyethersulfone (PES); and alloys or metals, such as stainless steel (e.g., SUS304) and nickel.

As a material for the surface layer, there may be used fluorine resin materials, such as polytetrafluoroethylene (PTFE), a tetrafluoroethylene-perfluoro(alkyl vinyl ether) copolymer (PFA), and a tetrafluoroethylene-hexafluoropropylene copolymer (FEP).

An elastic layer containing a cured silicone rubber and an adhesive layer may be formed between the base film and the surface layer.

The electrophotographic rotatable pressing member 4 is arranged so as to be opposed to a lower surface of the heater 2 and is brought into pressure contact with the heater 2 through intermediation of the film 3.

The electrophotographic rotatable pressing member 4 is pressurized to the surface protective layer 2*d* of the heater 2 through intermediation of the film 3 with a predetermined pressurizing force by a predetermined pressurizing mechanism (not shown). An elastic layer 4*b* of the electrophotographic rotatable pressing member 4 is elastically deformed in accordance with the pressurizing force, and a nip portion N having a predetermined width required for heat fixing of an unfixed toner image T is formed between the surface of the electrophotographic rotatable pressing member 4 and the surface of the film 3. The pressurizing force is appropriately set based on the type and size of a sheet being a product target, the type of a toner, and the configuration of the fixing device. A general pressurizing force is set to be from about 10 kgf to about 70 kgf.

A recording material P being a material to be heated is introduced into the nip portion N, and through the recording material P being held and conveyed, the recording material P is heated.

The electrophotographic rotatable pressing member 4 receives a drive force from a drive source M transmitted through a gear (power transmission mechanism) (not shown) and is driven to rotate in a counterclockwise direction of the arrow "b" at a predetermined rotational peripheral speed.

When the electrophotographic rotatable pressing member 4 is driven to rotate in the counterclockwise direction of the arrow "b" at the time of implementation of image formation, the film 3 is rotated in a direction of the arrow "a" in association with the rotation of the electrophotographic rotatable pressing member 4.

(2) Layer Configuration of Electrophotographic Rotatable Pressing Member 4

Figure 2:
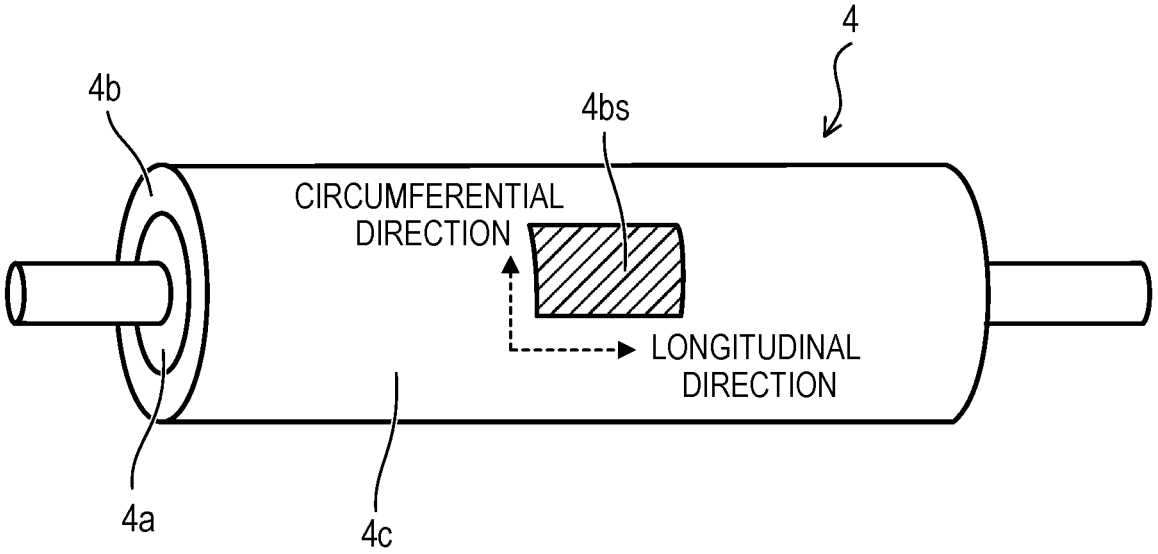
FIG. 2 is a perspective view for illustrating an electrophotographic rotatable pressing member 4 according to one embodiment of the present invention.

FIG. 2 is a perspective view for illustrating the electrophotographic rotatable pressing member 4 according to one embodiment of the present invention. The electrophotographic rotatable pressing member 4 includes a substrate 4*a*, the elastic layer 4*b* containing a cured silicone rubber, and a surface layer 4*c* formed of a fluorine-containing resin tube.

The substrate 4*a* is made of a metal such as iron, aluminum, or nickel, or an alloy, for example, stainless steel. When the electrophotographic rotatable pressing member 4 is mounted on the fixing device, the electrophotographic rotatable pressing member 4 is pressurized under a state in which shaft portions of the substrate 4*a* at both ends in which the elastic layer 4*b* is not formed are held by substrate-holders. Therefore, the substrate 4*a* is required to have strength sufficient for withstanding the pressurizing force, and hence iron or stainless steel is preferably used. Further, parts of the surface of the substrate 4*a* on which the elastic layer 4*b* is formed are generally subjected to adhesion treatment. As the adhesion treatment, physical treatment such as blasting or F-polishing and chemical treatment such as oxidation treatment, primer treatment, or coupling agent treatment may be performed alone or in combination.

(3) Elastic Layer 4*b* of Electrophotographic Rotatable Pressing Member 4

The elastic layer 4*b* forming the electrophotographic rotatable pressing member 4 contains a cured silicone rubber and needle-shaped fillers 4*b*1 dispersed in the cured silicone rubber. Further, the elastic layer 4*b* contains hollow parts 4*b*2. In a cut surface obtained by cutting the elastic layer 4*b* along a cross section "b" including a center axis of the substrate 4*a* in a longitudinal direction of the electrophotographic rotatable pressing member 4, a standard deviation of an area ratio $A_1/A_2$ is 0.08 or less, where $A_1$ represents a total of each sectional area (hereinafter sometimes referred to as "hollow part area") of the hollow parts 4*b*2 in a unit area of the cross section "b" being the cut surface in the longitudinal direction of the electrophotographic rotatable pressing member 4, and $A_2$ represents the unit area of the cross section "b".

When the standard deviation is 0.08 or less, the plurality of hollow parts 4*b*2 in the elastic layer 4*b* are uniformly present. Therefore, variation in thickness of the rubber skeletons in the elastic layer 4*b* is suppressed, and variation in strength of the rubber skeletons in the elastic layer 4*b* is suppressed. Therefore, it is considered that, even under pressurization, a stress is less liable to be concentrated on a part of the elastic layer 4*b*, and partial fracture of the rubber skeletons forming the hollow parts 4*b*2 is suppressed.

A lower limit value of the standard deviation is not particularly limited but is practically 0.01 or more. The standard deviation can be set to be 0.08 or less by controlling (suppressing), to a high degree, the flow of an emulsion-like liquid silicone rubber mixture containing needle-shaped fillers and a dispersed water-containing gel (described later) in a mold for molding at the time of being cured.

The elastic layer 4*b* is formed of a single layer. The thickness of the elastic layer 4*b* is not particularly limited as long as the thickness falls within a range capable of forming the nip portion N having a desired width but is preferably 2 mm or more and 5 mm or less.

(3-1) Base Polymer

A base polymer of the elastic layer 4*b* contains a cured product of an addition-curable liquid silicone rubber. The addition-curable liquid silicone rubber is an uncrosslinked silicone rubber containing organopolysiloxane (A) having an unsaturated aliphatic group, for example, a vinyl group and organopolysiloxane (B) having a Si—H group (hydrosilyl group). When the Si—H group is added to an unsaturated bond of the unsaturated aliphatic group by heating, a crosslinking reaction proceeds. Further, through appropriate adjustment of the amounts of the organopolysiloxane (A) having an unsaturated aliphatic group and the organopolysiloxane (B) having a Si—H group, a base polymer having a desired hardness can be obtained.

The hardness of the elastic layer 4*b* is measured based on "Vulcanized Rubber and Thermoplastic Rubber—Method of Determining Hardness—Third Section: Durometer Hardness" stipulated under "Japanese Industrial Standards (JIS)K 6253-3:2012" and is preferably 20 degrees or more and 80 degrees or less.

The addition-curable liquid silicone rubber generally contains a platinum compound as a catalyst for accelerating a crosslinking reaction. Further, the addition-curable liquid silicone rubber can be regulated for flowability within a range of not impairing the object of the present invention. Further, in the present invention, the elastic layer 4*b* may contain a filler or a filling material other than the needle-shaped fillers 4*b*1 in the present invention, and a compounding agent as known means for solving the problem without departing the scope of the feature of the present invention.

(3-2) Needle-Shaped Filler 4*b*1

It is preferred that the content ratio of the needle-shaped fillers 4*b*1 be 2 vol % or more and 15 vol % or less with respect to the elastic layer 4*b*. When the content ratio of the needle-shaped fillers 4*b*1 is set to be 2 vol % or more, the effect of suppressing circumferential creases can be obtained. Further, when the content ratio of the needle-shaped fillers 4*b*1 is set to be 15 vol % or less, the elastic layer 4*b* can be easily molded. Further, when the content ratio of the needle-shaped fillers 4*b*1 is set to be 15 vol % or less, an excessive decrease in elasticity of the elastic layer 4*b* can be avoided, and the nip portion N of the electrophotographic rotatable pressing member 4 in the fixing device can be easily ensured.

Figure 3:
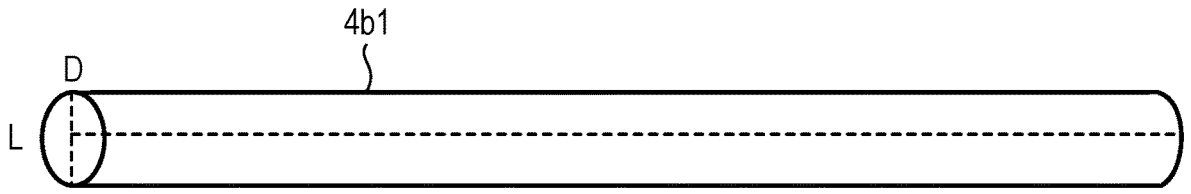
FIG. 3 is a schematic view of a needle-shaped filler.

As a material for the needle-shaped fillers 4*b*1, a material having a large ratio of a length L to a diameter D, that is, a large aspect ratio as illustrated in FIG. 3 can be preferably used.

As specific examples of the needle-shaped fillers 4*b*1, there are given pitch-based carbon fibers, PAN-based carbon fibers, glass fibers, and other inorganic whiskers. The needle-shaped fillers 4*b*1 having, as a more specific shape, an average diameter D of 5 μm or more and 11 μm or less, an average length L of 50 μm or more and 1,000 μm or less, and an aspect ratio of 5 or more and 120 or less in FIG. 3 can easily be obtained in an industrial manner. When the length L is 50 μm or more, the needle-shaped fillers 4*b*1 can be effectively aligned in the longitudinal direction of the electrophotographic rotatable pressing member 4.

The aspect ratio of the needle-shaped fillers 4*b*1 can be determined through use of the following expression based on the average length and the average diameter of the needle-shaped fillers 4*b*1.

$$\text{Aspect ratio} = \text{Average length}/\text{Average diameter}$$

In the following, description is made of a specific method of calculating an aspect ratio when the needle-shaped fillers 4*b*1 are carbon fibers. First, a sample cut out from the elastic layer 4*b* is fired at 700° C. for 1 hour in a nitrogen gas atmosphere to calcify and remove a silicone rubber component. Thus, the needle-shaped fillers 4*b*1 in the sample can be taken out. The content ratio of the needle-shaped fillers 4*b*1 in the elastic layer 4*b* can be determined by determining a volume of the needle-shaped fillers 4*b*1 taken out from the sample. Further, an aspect ratio of the needle-shaped fillers 4*b*1 can be determined through use of the above-mentioned expression by randomly selecting 100 or more needle-shaped fillers 4*b*1 and measuring an average length and average diameter thereof with an optical microscope. In this embodiment, the aspect ratio of the needle-shaped fillers 4*b*1 is represented by a value obtained by rounding off the first decimal place of the value obtained from the above-mentioned expression.

The step of forming the elastic layer 4*b* containing the needle-shaped fillers 4*b*1 includes, for example, a first step of curing an emulsion-like liquid silicone rubber mixture containing the needle-shaped fillers 4*b*1 and the water-containing gel in a sealed mold for molding and a second step of removing water from the cured product. In the first step, when the liquid silicone rubber mixture flows in the sealed mold for molding, the needle-shaped fillers 4*b*1 serve as cores, and the water-containing gel is easily aggregated. As a result, the hollow parts 4*b*2 present in the elastic layer 4*b* obtained through the second step are liable to be non-uniformly distributed. That is, as the amount of the needle-shaped fillers 4*b*1 in the rubber composition is larger, the standard deviation of the area ratio $A_1/A_2$ is liable to increase, where $A_1$ represents the hollow part area in the cut surface obtained by cutting the elastic layer 4*b* along the cross section including the center axis of the substrate 4*a*, and $A_2$ represents the unit area.

(3-3) Hollow Part 4*b*2

The elastic layer 4*b* of the electrophotographic rotatable pressing member 4 contains the hollow parts 4*b*2 in order to decrease the heat conductivity of the elastic layer 4*b*. That is, when the heat conductivity of the electrophotographic rotatable pressing member 4 is suppressed, escape of heat from the heating member to the substrate 4*a* is suppressed to improve a temperature increase speed of the heating member, with the result that the warm-up time can be reduced. The hollow parts 4*b*2 in the elastic layer 4*b* in the present invention are dispersed so that the standard deviation of the area ratio $A_1/A_2$ is 0.08 or less, where $A_1$ represents the hollow part area in the cut surface obtained by cutting the elastic layer 4*b* along the cross section "b" including the center axis of the substrate 4*a*, and $A_2$ represents the unit area.

Figure 4:
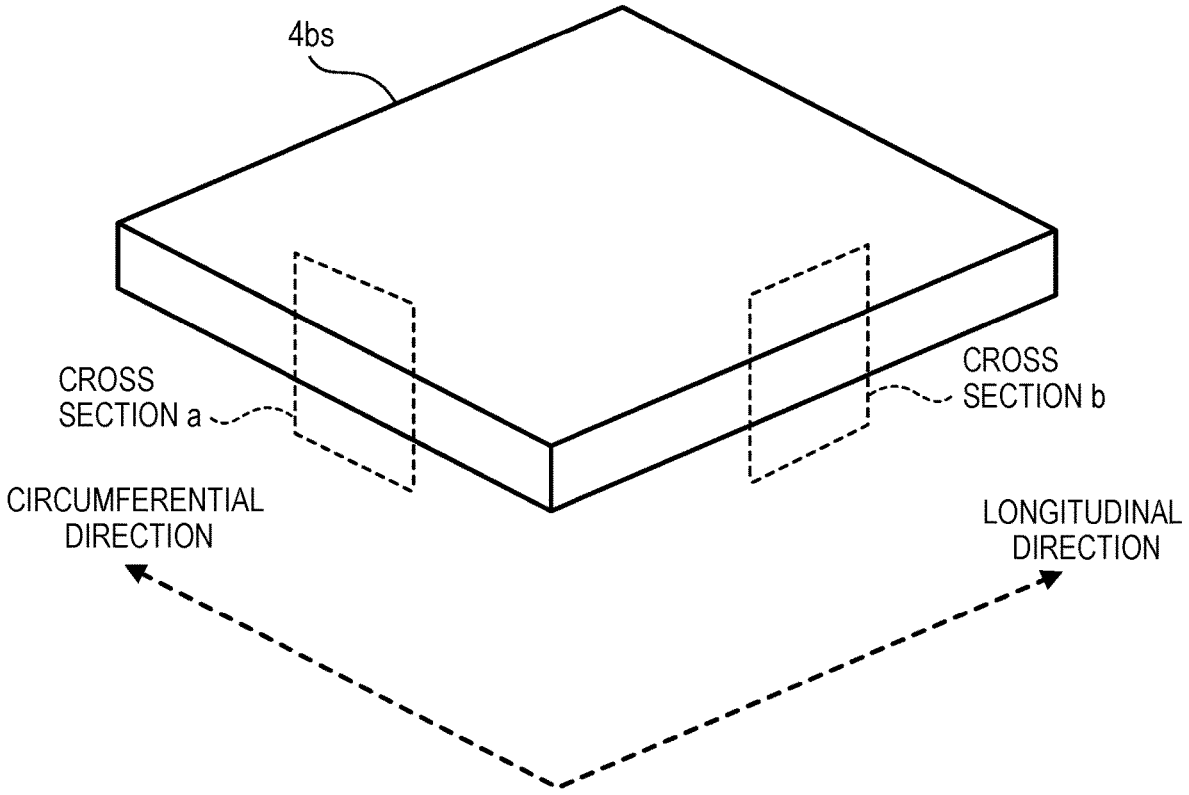
FIG. 4 is an enlarged perspective view of a sample cut out from an elastic layer.

The standard deviation of the area ratio $A_1/A_2$ can be determined as follows. First, the elastic layer 4*b* of the electrophotographic rotatable pressing member 4 is cut out by 3 mm each in the circumferential direction and in the longitudinal direction of the electrophotographic rotatable pressing member 4 as illustrated in a sample 4*bs* represented by the shaded area of FIG. 2. In this case, the sample 4*bs* is cut out through use of a razor along a cross section including a center axis of the substrate 4*a* in the longitudinal direction of the electrophotographic rotatable pressing member 4. The cutout sample is like the sample 4*bs* of FIG. 4. The cross section "b" of the cutout sample 4*bs* of FIG. 4 in the longitudinal direction of the electrophotographic rotatable pressing member 4 is photographed at an accelerating voltage of 3 kV and a magnification of 100 times through use of a scanning electron microscope (SEM) (product name: XL30 SFEG manufactured by FEI Company). The obtained SEM image of the cross section "b" is binarized through use of image analysis software (product name: Image-Pro Plus 5.0 J manufactured by Media Cybernetics Inc.) in a range of 500 μm toward the substrate 4*a* from a radially outer surface (surface immediately below the surface layer 4*c* in the case in which there is the surface layer 4*c*) of the elastic layer 4*b* and 1,200 μm in the longitudinal direction of the electrophotographic rotatable pressing member 4. The reason for setting the analysis region to 500 μm from the radially outer surface of the elastic layer 4*b* is that, during the investigations of the inventors of the present invention, the above-mentioned analysis region was found to be a region in which a difference in standard deviation of the area ratio $A_1/A_2$ was easily exhibited. This analysis region receives a large shearing stress at the time of flow of the liquid composition and is liable to be demulsified at the time of heating of the rubber composition.

Therefore, it is considered that the difference is easily exhibited when the dispersion of the hollow parts 4*b*2 is evaluated based on the standard deviation of the area ratio $A_1/A_2$. Binarization is performed by Otsu's discriminant analysis method. The obtained binarized image is segmentalized to a size of 53 μm square. The obtained segmentalized images are each determined for the hollow part area $A_1$ and the unit area $A_2$, and each area ratio $A_1/A_2$ is calculated. The reason for setting the unit area for segmentalizing the binarized image to 53 μm square is that, during the investigations of the inventors of the present invention, the standard deviation of a ratio (area ratio) of the hollow part area with respect to the unit area of 53 μm square was found to be satisfactorily correlated to the results of presence or absence of a change in hardness after the severe durability test of the electrophotographic rotatable pressing member.

A standard deviation of the sample 4*bs* is calculated based on the obtained area ratio $A_1/A_2$. When the hollow parts 4*b*2 are non-uniformly distributed, the number of the segmentalized images each having a large hollow part area and the number of the segmentalized images each having a small hollow part area are both large, and hence a standard deviation obtained by measuring a large number of segmentalized images becomes large. Meanwhile, when the hollow parts 4*b*2 are uniformly distributed, the number of the segmentalized images each having a large hollow part area and the number of the segmentalized images each having a small hollow part area are both small, and hence a standard deviation obtained by measuring a large number of segmentalized images becomes small.

Calculation of a standard deviation of the area ratio $A_1/A_2$ is performed with respect to the sample 4*bs* obtained from six positions of the elastic layer 4*b*. The samples 4*bs* are cut out from a total of six positions of the elastic layer 4*b*, the six positions including, when a total axial length of the elastic layer 4*b* is represented by $L^1$, two positions of 0.1 $L^1$ from both ends and one position of 0.5 $L^1$ being the center, and three positions different from the above-mentioned positions by 180° in the circumferential direction. In the electrophotographic rotatable pressing member 4 of the present invention, all the standard deviations of the area ratios $A_1/A_2$ obtained from the samples 4*bs* cut out from the six positions become 0.08 or less.

When, in the standard deviations of the area ratios $A_1/A_2$ obtained from the samples 4*bs* cut out from the six positions of the elastic layer 4*b* of the electrophotographic rotatable pressing member 4, the standard deviation of the area ratio $A_1/A_2$ is larger than 0.08 even at one position, a change in hardness in that position of the elastic layer 4*b* becomes large. As a result, when the electrophotographic rotatable pressing member 4 having changed hardness is used in the fixing device, sheet creases are liable to occur at the time of sheet passage. Therefore, the electrophotographic rotatable pressing member 4 including the elastic layer 4*b* in which the standard deviation of the area ratio $A_1/A_2$ is larger than 0.08 even at one position has unsatisfactory durability, and the member needs to be frequently replaced.

Further, it is preferred that the elastic layer 4*b* have a hollow part ratio of 20 vol % or more and 60 vol % or less. When the hollow part ratio is 20 vol % or more, the above-mentioned effect of sufficiently reducing the warm-up time can be obtained. Even when an attempt is made to form the elastic layer 4*b* having a hollow part ratio of more than 60 vol %, it may be difficult to mold the elastic layer 4*b*. When the elastic layer 4*b* has a high hollow part ratio, the warm-up time can be reduced, and hence the hollow part ratio is more preferably 40 vol % or more and 60 vol % or less.

The hollow part ratio of the elastic layer 4*b* can be determined as follows. First, the elastic layer 4*b* is cut at any position through use of a razor to obtain an evaluation sample. The obtained evaluation sample is measured for a volume at 25° C. by an immersion specific gravity measuring device (product name: SGM-6 manufactured by Mettler Toledo International Inc.) (hereinafter this volume is represented by "Vail"). Next, the evaluation sample subjected to volume measurement is heated at 700° C. for 1 hour in a nitrogen gas atmosphere through use of a thermogravimetric measurement device (product name: TGA851e/SDTA manufactured by Mettler Toledo International Inc.), to thereby decompose and remove a silicone rubber component. A reduction amount of weight in this case is represented by Mp. When inorganic fillers are contained in the elastic layer 4*b* in addition to the needle-shaped fillers 4*b*1, a residue obtained after decomposition and removal of the silicone rubber component contains the needle-shaped fillers 4*b*1 and the inorganic fillers in a mixed state.

A total volume of the needle-shaped fillers 4*b*1 and the inorganic fillers at 25° C. is measured in this state by a dry-process automatic densitometer (product name: Accy-Pyc 1330-1 manufactured by Shimadzu Corporation). Volume measurement is performed ten times for each replacement of nitrogen gas, and an arithmetic average thereof is represented by Va.

A hollow part ratio of the evaluation sample can be determined from the following expression based on the above-mentioned values. Calculation is performed with the density of the silicone rubber component being 0.97 g/cm$^3$ (hereinafter the density is represented by "ρp").

$$\text{Hollow part ratio (vol \%)}=[\{Vall-(Mp/\rho p+Va)\}/Vall]\times 100$$

The hollow part ratio described in this embodiment is defined as follows. That is, any portions are cut out from five positions to obtain evaluation samples, and an average value of hollow part ratios determined from the evaluation samples is defined as the hollow part ratio of the elastic layer 4*b*.

It is preferred that the hollow part 4*b*2 in the elastic layer 4*b* have such a diameter that, when the elastic layer 4*b* is cut in a thickness direction with a razor, 80% or more of the number of the hollow parts 4*b*2 appearing on the cut surface falls within a range of 5 μm or more and 30 μm or less. Here, the diameter of the hollow part 4*b*2 is obtained by observing the cross section "b" being the cut surface at an accelerating voltage of 3 kV and a magnification of 100 times through use of a scanning electron microscope (SEM) (product name: XL30 SFEG manufactured by Philips Inc.), binarizing the cross section "b" through use of image analysis software (product name: Image-Pro Plus 5.0 J manufactured by Media Cybernetics Inc.), and defining, as the diameter of the hollow part 4*b*2, a half of a total value of the maximum length and the minimum length of the diameter of the hollow part 4*b*2. The hollow part 4*b*2 has a diameter as small as 30 μm or less. Therefore, at the time of passage of a sheet for printing a second surface in duplex printing, an image defect is less liable to occur on an image printed on a first surface of the sheet that is brought into contact with a pressure roller.

(4) Surface Layer 4*c*

In order to give releasability to the electrophotographic rotatable pressing member 4, the surface layer 4*c* formed of a fluorine-containing resin tube may be formed on the elastic layer 4*b*.

As a material for the surface layer 4*c*, a fluorine-containing resin is used from the viewpoint of releasability for the recording material P at the time of image printing. As specific examples of the fluorine-containing resin, there are given a tetrafluoroethylene-perfluoro (alkyl vinyl ether) copolymer (PFA), polytetrafluoroethylene (PTFE), and a tetrafluoroethylene-hexafluoropropylene copolymer (FEP). Further, two or more kinds of the materials listed above may be blended to be used, and additives may be added.

The thickness of the surface layer 4*c* is not particularly limited as long as the thickness falls within a range capable of giving sufficient releasability to the electrophotographic rotatable pressing member 4 but is preferably 20 μm or more and 50 μm or less.

(5) Method of Manufacturing Electrophotographic Rotatable Pressing Member 4

The manufacturing method described below enables the electrophotographic rotatable pressing member 4 to be obtained, the electrophotographic rotatable pressing member 4 including the elastic layer 4*b* in which the hollow parts 4*b*2 are dispersed, the hollow parts 4*b*2 being formed by evaporating water in a silicone rubber containing the needle-shaped fillers 4*b*1 and dispersed water.

(i) Preparation Step of Liquid Composition for Forming Elastic Layer 4*b*

In a method of forming the elastic layer 4*b* containing the hollow parts 4*b*2 according to the present invention, an emulsion-like liquid composition containing a water-containing gel, an addition-curable liquid silicone rubber, and the needle-shaped fillers 4*b*1 is used.

The water-containing gel, the addition-curable liquid silicone rubber, and the needle-shaped fillers 4*b*1 are mixed and stirred through use of a known filler mixing and stirring unit, for example, a planetary universal mixing and stirring machine, thereby being capable of preparing an emulsion-like liquid composition in which the needle-shaped fillers 4*b*1 and the water-containing gel are dispersed in the addition-curable liquid silicone rubber.

Figure 5:
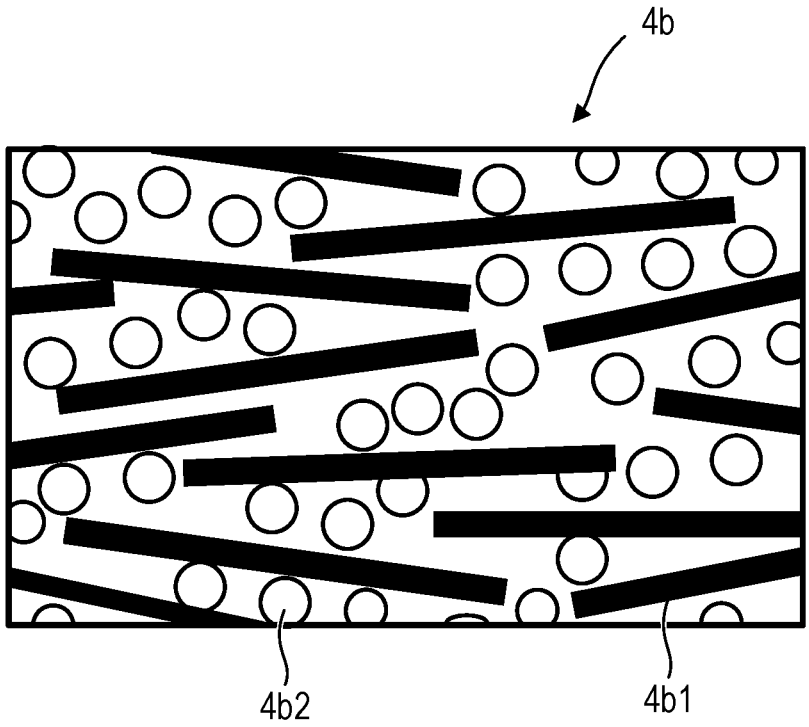
FIG. 5 is a schematic view of a cross section of the sample cut out from the elastic layer.

A cured product of a composition in which water is finely dispersed is formed through use of the emulsion-like liquid composition containing the water-containing gel, and then dehydrated, thereby being capable of obtaining the elastic layer 4*b* containing the fine hollow parts 4*b*2 as illustrated in FIG. 5.

As the water-containing gel, a gel obtained by swelling a water-absorbing polymer and clay mineral through introduction of water can be used. The water-containing gel dispersed in the emulsion-like liquid composition has a diameter of about 1 μm or more and about 30 μm or less and is less liable to inhibit the alignment of the needle-shaped fillers 4*b*1. Therefore, the elastic layer 4*b* having a high hollow part ratio and containing the needle-shaped fillers 4*b*1 aligned highly can be formed.

Meanwhile, when a liquid composition containing hollow particles (having a diameter of about 40 μm), for example, resin balloons is injected into a mold for cast molding, instead of the water-containing gel, to form an elastic layer, in the case in which shells of the hollow particles flow in a cavity of the mold for cast molding, the alignment of the needle-shaped fillers 4*b*1 is inhibited. Therefore, it is difficult to form an elastic layer that satisfies both a high hollow part ratio and high alignment of the needle-shaped fillers 4*b*1.

Further, even when an elastic layer is formed by injecting a liquid composition containing a foaming agent for forming hollow parts into a mold for cast molding, the alignment of the needle-shaped fillers 4*b*1 is disturbed at the time of foaming of the foaming agent, and hence it is difficult to align the needle-shaped fillers 4*b*1 in the longitudinal direction.

Of the water-containing gel, as the water-absorbing polymer, there are given a polymer, a copolymer, or a crosslinked product of acrylic acid, methacrylic acid, and metal salts thereof. Of those, an alkali metal salt of polyacrylic acid and a crosslinked product thereof (product name: RHEOGIC 250H manufactured by Toagosei Co., Ltd.) can be suitably used, and can easily be obtained in an industrial manner. Further, clay mineral having a thickening effect and swollen with water is suitable for preparing a liquid composition for forming the emulsion-like elastic layer 4*b*. As a thickening agent containing such clay mineral, there is given "BEN-GEL W-200U" (product name) manufactured by Hojun Co., Ltd.

The emulsion-like liquid composition may contain a platinum compound serving as a catalyst for accelerating a crosslinking reaction, a filler, a filling material, and a compounding agent.

Further, the liquid composition may be prepared by mixing and stirring after adding an emulsifier and a viscosity modifier as necessary. As an additive for emulsification, there is given a surfactant, for example, nonionic surfactant (sorbitan fatty acid ester (product name: IONET HLB4.3 manufactured by Sanyo Chemical Industries, Ltd.)).

The hollow part ratio of the elastic layer 4*b* of the electrophotographic rotatable pressing member 4 can be produced by adjusting the content of the water-containing gel in the liquid composition for forming the elastic layer 4*b*. A specific method of adjusting the hollow part ratio is described below. The density of the water-containing gel and the density of the addition-curable liquid silicone rubber are both 1.0 g/cm$^3$. Further, the density of the needle-shaped fillers 4*b*1 is 2.2 g/cm$^3$ when the needle-shaped fillers 4*b*1 are pitch-based carbon fibers used in an Example described later. Based on those values, the amount of the water-containing gel is regulated so that the content ratio of the water-containing gel with respect to the total volume of the liquid composition to be used for forming the elastic layer 4*b* becomes 20 vol % or more and 60 vol % or less. The volume of the hollow parts in the elastic layer 4*b* after dehydration is substantially the same as that of the water-containing gel in the liquid composition. Therefore, the elastic layer 4*b* having a hollow part ratio of 20 vol % or more and 60 vol % or less can be produced by setting the volume of the water-containing gel with respect to the total volume of the liquid composition within the above-mentioned range.

(ii) Forming Step of Layer of Liquid Composition

Figure 6:
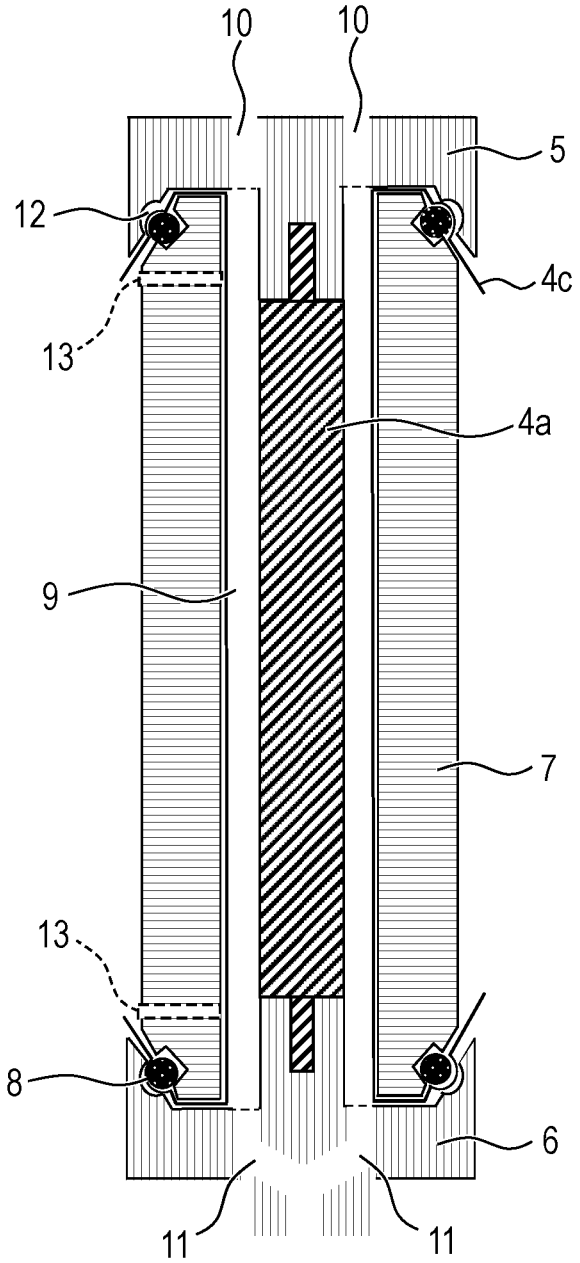
FIG. 6 is a schematic explanatory view of a mold to be used for manufacturing the electrophotographic rotatable pressing member.

This step is specifically described with reference to FIG. 6. FIG. 6 is a schematic explanatory view of a mold at the time of manufacturing the electrophotographic rotatable pressing member 4. In FIG. 6, the surface layer 4*c* formed of a fluorine-containing resin tube having a cylindrical inner surface is fixed to a tubular mold 7. An inner surface of the surface layer 4*c* may be appropriately subjected to primer application treatment as necessary before the liquid composition is subjected to cast molding in order to improve adhesion of the surface layer 4*c* to the elastic layer 4*b*. The substrate 4*a* of the electrophotographic rotatable pressing member 4 according to the present invention is placed in the tubular mold 7 after parts of the substrate 4*a* on which the elastic layer 4*b* is to be formed are subjected to adhesion treatment on a surface thereof, and held by substrate-holders 5 and 6. A cavity 9 is formed between an outer peripheral surface of the substrate 4*a* and an inner peripheral surface of the surface layer 4*c*. At this time, the cavity 9 communicates to outside through communication paths 10 and 11.

First, in order to improve shape transferability at the time of molding, the tubular mold 7 is decompressed through two horizontal holes 13 formed on the tubular mold 7 to bring the surface layer 4*c* into close contact with an inner wall of the tubular mold 7.

Then, in the mold in which the substrate 4*a* is held by the substrate-holders 5 and 6 set at both ends of the tubular mold 7, the liquid composition of the present invention prepared in the above-mentioned step (i) is filled into the cavity 9 formed between the outer peripheral surface of the substrate 4*a* and the inner peripheral surface of the tubular mold 7 through the communication path 11. At this time, bubble catching can be reduced at the time of cast molding involving injecting the liquid composition by mounting a decompressor, for example, an aspirator (not shown) at the end of the communication path 10 to bring the inside of the cavity 9 into a decompressed state. When bubble catching is reduced, the flow of the liquid composition at the time of thermal expansion in a step (iii) described later can be reduced, and hence the progress of demulsification is suppressed to obtain uniform distribution of the hollow parts 4*b*2. As a result, the standard deviation of the area ratio $A_1/A_2$ becomes small, where $A_1$ represents the hollow part area in the cut surface obtained by cutting the elastic layer 4*b* of the present invention along the cross section including the center axis of the substrate 4*a*, and $A_2$ represents the unit area. It is necessary to set the decompression in the cavity 9 to be lower than that for close adhesion between the surface layer 4*c* and the tubular mold 7 so as to keep a state in which the surface layer 4*c* and the tubular mold 7 are brought into close contact with each other also at the time of injection of the liquid composition.

(iii) Crosslinking and Curing Step of Silicone Rubber Component

Next, the cavity 9 filled with the liquid composition is sealed by closing the communication paths 10 and 11 that have been opened as flow passages for cast molding with a screw, a ball valve, and the like so that the liquid composition does not flow out. In this state, the liquid composition is heated at a temperature less than the boiling point of water, for example, at 60° C. or more and 90° C. or less for 5 minutes to 120 minutes to cure the silicone rubber component being the base polymer of the elastic layer 4*b*.

The mold to be used in the step (iii) of the electrophotographic rotatable pressing member 4 has a seal structure for implementing high-level sealing. Therefore, the liquid silicone rubber can be crosslinked and cured by heating to provide a cured product without causing the liquid composition in the cavity 9 to flow. In the case in which the cavity 9 is not sealed at a high level in spite of the fact that the cavity 9 is sealed, when the pressure in the mold is increased due to thermal expansion of the liquid composition at the time of heating, the liquid composition leaks to flow outside the mold through fitting portions between the tubular mold 7 and the substrate-holders 5 and 6, resulting in disruption of the emulsified state of the liquid composition. Therefore, the seal structure for implementing high-level sealing is required.

Specifically, as illustrated in FIG. 6, the seal structure for implementing high-level sealing is a structure in which, when sealing is performed by holding the surface layer 4*c* between the tubular mold 7 and the substrate-holders 5 and 6 through intermediation of O-rings 8, the O-rings 8 held in grooves of the tubular mold 7 are brought into close contact with grooves 12 formed in portions of the substrate-holders 5 and 6 opposed to the O-rings 8 in a crushed state. With this structure, a sealing area can be widely formed. Therefore, high-level sealing can be implemented, and the liquid composition at the time of heating can be prevented from flowing.

Each of the O-rings 8 is held by the tubular mold 7 under a state of projecting outside from a tapered surface of the tubular mold 7 of the fitting portion between the tubular mold 7 and the substrate-holder 5 or 6. The groove 12 is formed with a curvature in a groove depth direction in a circumferential shape in the fitting portion between the substrate-holder 5 or 6 and the tubular mold 7 in conformity with the shape of the O-ring 8 arranged in the tubular mold 7.

It is preferred that the depth of the groove 12 have a value of 20% or more and 100% or less with respect to an amount (projection amount) by which the O-ring 8 projects from the tapered surface of the tubular mold 7. With this depth of the groove 12, the contact area in which the O-ring 8 and the groove 12 are opposed to each other can be prevented from becoming excessively small. Further, it is possible to prevent a situation in which the O-ring 8 and the groove 12 are not brought into pressure contact with each other to make it difficult to perform high-level sealing. Further, it is preferred that the curvature of the groove 12 be set to be smaller than that of a cross section of the O-ring 8. With this curvature of the groove 12, the O-ring 8 is easily crushed into a shape in conformity with the groove 12 when the tubular mold 7 and the substrate-holders 5 and 6 are fitted with each other. Therefore, high-level sealing can be reliably achieved.

(iv) Demolding Step

The addition-curable liquid silicone rubber in the liquid composition is crosslinked and cured in the step (iii), and then the mold is appropriately cooled with water or air, to thereby demold the cured product. Alternatively, the electrophotographic rotatable pressing member 4 may be demolded after the elastic layer 4*b* is formed in the step (v).

(v) Dehydration Step

Water is removed from the cured product of the liquid composition laminated on the substrate 4*a* by heating treatment to form the hollow parts 4*b*2. As the heating treatment condition, it is desired that a temperature be 100° C. or more and 250° C. or less, and a heating time be 1 hour to 5 hours. The step (v) may be performed before or after the step (iv).

(vi) Lamination Step of Surface Layer 4*c*

As described above, the surface layer 4*c* can be laminated by a method involving fixing and arranging the fluorine-containing resin tube in the mold for cast molding in advance and subjecting the liquid composition to cast molding. Alternatively, the surface layer 4*c* can be laminated also by a method involving forming the elastic layer 4*b*, covering the elastic layer 4*b* with the fluorine-containing resin tube, and bonding and fixing the fluorine-containing resin tube to the elastic layer 4*b* with an adhesive.

According to one embodiment of the present invention, an electrophotographic rotatable pressing member in which hardness is less liable to change from an initial state even after long-term use can be obtained.

Further, according to another embodiment of the present invention, a method of manufacturing an electrophotographic rotatable pressing member in which hardness is less liable to change from an initial state even after long-term use can be obtained. According to still another embodiment of the present invention, a fixing device capable of stably providing a high-quality electrophotographic image can be obtained.

EXAMPLES

Materials used in each of the following Examples are described.

(Substrate 4*a*)

As the substrate 4*a*, a substrate made of iron (having a diameter of 24.5 mm and a length of a forming region of the elastic layer 4*b* of 330 mm) was used.

(Base Polymer)

As the base polymer of the elastic layer 4*b*, an addition-curable liquid silicone rubber having a viscosity of 10 Pa·s at a shearing speed of 10 (l/s) in an environment of 25° C. was used.

(Water-Containing Gel)

As the water-containing gel, a water-containing gel, which was prepared by adding 99 parts by mass of ion-exchange water to 1 part by mass of a thickening agent (product name: "BEN-GEL W-200U" manufactured by Hojun Co., Ltd.) containing, as a main component, sodium polyacrylate and smectite-based clay mineral and sufficiently stirring and swelling the mixture, was used.

(Needle-Shaped Filler 4*b*1)

As the needle-shaped fillers 4*b*1, the following four kinds of fibrous materials were used.

1. Pitch-based carbon fiber, product name: GRANOC Milled Fiber XN-100-05M (manufactured by Nippon Graphite Fiber Co., Ltd.); fiber diameter: 9 μm, fiber length: 50 μm, aspect ratio: 6, density: 2.2 g/cm$^3$, hereinafter referred to as "100-05M".
2. Pitch-based carbon fiber, product name: DIALEAD K223HM (manufactured by Mitsubishi Plastics, Inc.); fiber diameter: 11 μm, fiber length: 200 μm, aspect ratio: 18, density: 2.2 g/cm$^3$, hereinafter referred to as "K223HM".
3. PAN-based carbon fiber, product name: TORAYCA Milled Fiber MLD-300 (manufactured by Toray Industries, Inc.); fiber diameter: 7 μm, fiber length: 130 μm, aspect ratio: 19, density: 1.8 g/cm$^3$, hereinafter referred to as "MLD-300".
4. Glass fiber, product name: EFH150-01 (manufactured by Central Glass Co., Ltd.); fiber diameter: 11 μm, fiber length: 150 μm, aspect ratio: 14, density: 2.6 g/cm$^3$, hereinafter referred to as "150-01".

(Surface Layer 4*c*)

As the surface layer 4*c*, a PFA tube having a thickness of 40 μm and an outer diameter of 29.0 mm was used. As the PFA tube, the following commercially available product was used.

<product name: Teflon (trademark) PFA 451HP-J (manufactured by Du Pont-Mitsui Fluorochemicals Co., Ltd.), hereinafter referred to as "451HP-J">

Manufacturing of Electrophotographic Rotatable Pressing Member 4

Experimental Example A

Example A-1

An uncrosslinked addition-curable liquid silicone rubber being the base polymer, "100-05M" being the needle-shaped fillers 4*b*1, and a water-containing gel were stirred at a rotation number of a stirring blade of 80 rpm for 30 minutes through use of a universal mixing and stirring machine (product name: T.K. HIVIS MIX Model 2P-1 manufactured by Primix Corporation) to prepare an emulsion-like liquid composition. In this case, the uncrosslinked addition-curable liquid silicone rubber and the needle-shaped fillers 4*b*1 were blended so that the content ratio of the needle-shaped fillers 4*b*1 was 15 vol % as shown in Table 1.

In order to obtain the configuration as illustrated in FIG. 6, a PFA tube having an inner surface subjected to adhesion treatment with a primer (product name: DY39-067 manufactured by Dow Corning Toray Co., Ltd.) serving as the surface layer 4*c* was inserted and fixed to an inner surface of the tubular mold 7 having a pipe shape with an inner diameter of 30 mm. Then, the substrate 4*a* subjected to adhesion treatment with a primer (product name: DY39-051 manufactured by Dow Corning Toray Co., Ltd.) was set inside the tubular mold 7 so as to be held by the substrate-holders 5 and 6 at both ends as illustrated in FIG. 6. Then, the substrate-holders 5 and 6 were brought into pressure contact with the tubular mold 7 to be fixed thereto.

Next, decompression was performed with a unit (not shown) through the horizontal holes 13 to bring the PFA tube into close contact with an inner wall of the tubular mold 7. After that, the liquid composition prepared in advance was injected into the cavity 9 through the communication path 11 to fill the cavity 9 with the liquid composition. In this state, the communication path 11 was sealed with a screw (not shown), and the communication path 10 was sealed with a ball valve (not shown).

As the O-ring 8, a ring having a diameter in cross section of 3.5 mm was used and held in the groove of the tubular mold 7 so as to project from the tapered surface of the tubular mold 7. The curvature of each of the grooves 12 formed in the substrate-holders 5 and 6 was set to be round so as to draw an arc having a radius of 2 mm in conformity with the shape of the O-ring 8. Further, the depth of the groove 12 is set to be 60% with respect to the projection amount of the O-ring 8 from the tapered surface of the tubular mold 7.

Next, the mold having the liquid composition sealed therein was heated at 90° C. for 1 hour in a hot-air oven to crosslink and cure the silicone rubber in the liquid composition. After the mold was cooled, the substrate-holders 5 and 6 were removed from the tubular mold 7. The cured product in the tubular mold 7 was heated at 130° C. for 4 hours and then 200° C. for 4 hours in the hot-air oven to evaporate water in the cured silicone rubber layer. Thus, the elastic layer **4*b* formed of a single layer containing the needle-shaped fillers 4*b*1 and the dispersed hollow parts 4*b*2** was formed. Finally, an unnecessary end portion was cut to provide an electrophotographic rotatable pressing member No. A-01.

The standard deviation of the area ratio $A_1/A_2$ was 0.08, where $A_1$ represents the hollow part area in the cut surface obtained by cutting the elastic layer **4*b* of the obtained electrophotographic rotatable pressing member No. A-01 along the cross section "b" including the center axis of the substrate 4*a*, and $A_2$ represents the unit area. Further, the hollow part ratio of the elastic layer 4*b*** of the electrophotographic rotatable pressing member No. A-01 was 60 vol %.

The standard deviation of the area ratio $A_1/A_2$ of the electrophotographic rotatable pressing member No. A-01 was measured through use of an electrophotographic rotatable pressing member obtained by the same manufacturing method as that for the electrophotographic rotatable pressing member No. A-01. The standard deviation was measured as follows. The samples **4*bs*, each having a size of 3 mm in a long axis direction of the elastic layer 4*b* and a size of 3 mm in a circumferential direction thereof, were cut out from a total of six positions of the elastic layer 4*b*, the six positions including two positions of 33 mm from both ends and one position of 165 mm being the center with respect to a length of 330 mm of the elastic layer 4*b* and three positions different from the above-mentioned positions by 180° in the circumferential direction, and as described in the section "(3-3) Hollow part 4*b*2", the standard deviation of the area ratio $A_1/A_2$ in the cross section "b" was calculated, where $A_1$ represents the hollow part area and $A_2$ represents the unit area. Of the standard deviations of the area ratios $A_1/A_2$ of the six samples 4*bs***, the maximum value was shown in Table 1 as the standard deviation of the electrophotographic rotatable pressing member No. A-01.

Example A-2

An electrophotographic rotatable pressing member No. A-02 was obtained under the same condition as that of Example A-1 except that, when the same liquid composition as that of Example A-1 was injected into the cavity 9 through the communication path 11, the cavity 9 was filled with the liquid composition after the cavity 9 was decompressed through use of a decompressor (product name: VUH07-66A manufactured by Nihon Pisco Co., Ltd.) mounted at the end of the communication path 10.

The standard deviation of a hollow part area ratio was measured in the same manner as in Example A-1 through use of an electrophotographic rotatable pressing member obtained by the same manufacturing method as that for the electrophotographic rotatable pressing member No. A-02. Of the standard deviations, the maximum value was shown in Table 1 as the standard deviation of the electrophotographic rotatable pressing member No. A-02.

Comparative Example A-1

An electrophotographic rotatable pressing member No. A-03 was obtained under the same condition as that of Example A-1 except that substrate-holders having no groove 12 were used as the substrate-holders 5 and 6.

The standard deviation of the area ratio $A_1/A_2$ was measured in the same manner as in Example A-1 through use of an electrophotographic rotatable pressing member obtained by the same manufacturing method as that for the electrophotographic rotatable pressing member No. A-03. Of the standard deviations, the maximum value was shown in Table 1 as the standard deviation of the electrophotographic rotatable pressing member No. A-03.

Example B-1

An uncrosslinked addition-curable liquid silicone rubber being the base polymer, "K223HM" being the needle-shaped fillers **4*b*1, and a water-containing gel were mixed, being stirred at a rotation number of a stirring blade of 80 rpm for 30 minutes through use of a universal mixing and stirring machine (product name: T.K. HIVIS MIX Model 2P-1 manufactured by Primix Corporation) to prepare an emulsion-like liquid composition. In this case, the uncrosslinked addition-curable liquid silicone rubber and the needle-shaped fillers 4*b*1 were blended so that the content ratio of the needle-shaped fillers 4*b*1** was 7 vol % as shown in Table 1.

Except for the foregoing, an electrophotographic rotatable pressing member No. B-01 was obtained under the same condition as that of Example A-1. The elastic layer **4*b*** of the obtained electrophotographic rotatable pressing member No. B-01 had a hollow part ratio of 40 vol %.

The standard deviation of the area ratio $A_1/A_2$ was measured in the same manner as in Example A-1 through use of an electrophotographic rotatable pressing member obtained by the same manufacturing method as that for the electrophotographic rotatable pressing member No. B-01. Of the standard deviations, the maximum value was shown in Table 1 as the standard deviation of the electrophotographic rotatable pressing member No. B-01.

Example B-2

An electrophotographic rotatable pressing member No. B-02 was obtained under the same condition as that of Example B-1 except that, when the same liquid composition as that of Example B-1 was injected into the cavity 9 through the communication path 11, the cavity 9 was filled with the liquid composition after the cavity 9 was decompressed through use of a decompressor (product name: VUH07-66A manufactured by Nihon Pisco Co., Ltd.) mounted at the end of the communication path 10.

The standard deviation of the area ratio $A_1/A_2$ was measured in the same manner as in Example A-1 through use of an electrophotographic rotatable pressing member obtained by the same manufacturing method as that for the electrophotographic rotatable pressing member No. B-02. Of the standard deviations, the maximum value was shown in Table 1 as the standard deviation of the electrophotographic rotatable pressing member No. B-02.

Comparative Example B-1

An electrophotographic rotatable pressing member No. B-03 was obtained under the same condition as that of Example B-1 except that substrate-holders having no groove 12 were used as the substrate-holders 5 and 6.

The standard deviation of the area ratio $A_1/A_2$ was measured in the same manner as in Example A-1 through use of an electrophotographic rotatable pressing member obtained by the same manufacturing method as that for the electrophotographic rotatable pressing member No. B-03. Of the standard deviations, the maximum value was shown in Table 1 as the standard deviation of the electrophotographic rotatable pressing member No. B-03.

Example C-1

An uncrosslinked addition-curable liquid silicone rubber being the base polymer, "MLD-300" being the needle-shaped fillers **4*b*1, and a water-containing gel were stirred at a rotation number of a stirring blade of 80 rpm for 30 minutes through use of a universal mixing and stirring machine (product name: T.K. HIVIS MIX Model 2P-1 manufactured by Primix Corporation) to prepare an emulsion-like liquid composition. In this case, the uncrosslinked addition-curable liquid silicone rubber and the needle-shaped fillers 4*b*1 were blended so that the content ratio of the needle-shaped fillers 4*b*1** was 2 vol % as shown in Table 1.

Except for the foregoing, an electrophotographic rotatable pressing member No. C-01 was obtained under the same condition as that of Example A-1. The elastic layer **4*b*** of the obtained electrophotographic rotatable pressing member No. C-01 had a hollow part ratio of 20 vol %.

The standard deviation of the area ratio $A_1/A_2$ was measured in the same manner as in Example A-1 through use of an electrophotographic rotatable pressing member obtained by the same manufacturing method as that for the electrophotographic rotatable pressing member No. C-01. Of the standard deviations, the maximum value was shown in Table 1 as the standard deviation of the electrophotographic rotatable pressing member No. C-01.

Example C-2

An electrophotographic rotatable pressing member No. C-02 was obtained under the same condition as that of Example C-1 except that, when the same liquid composition as that of Example C-1 was injected into the cavity 9 through the communication path 11, the cavity 9 was filled with the liquid composition after the cavity 9 was decompressed through use of a decompressor (product name: VUH07-66A manufactured by Nihon Pisco Co., Ltd.) mounted at the end of the communication path 10.

The standard deviation of a hollow part area ratio was measured in the same manner as in Example A-1 through use of an electrophotographic rotatable pressing member obtained by the same manufacturing method as that for the electrophotographic rotatable pressing member No. C-02. Of the standard deviations, the maximum value was shown in Table 1 as the standard deviation of the electrophotographic rotatable pressing member No. C-02.

Comparative Example C-1

An electrophotographic rotatable pressing member No. C-03 was obtained under the same condition as that of Example C-1 except that substrate-holders having no groove 12 were used as the substrate-holders 5 and 6.

The standard deviation of the area ratio $A_1/A_2$ was measured in the same manner as in Example A-1 through use of an electrophotographic rotatable pressing member obtained by the same manufacturing method as that for the electrophotographic rotatable pressing member No. C-03. Of the standard deviations, the maximum value was shown in Table 1 as the standard deviation of the electrophotographic rotatable pressing member No. C-03.

Example D-1

An uncrosslinked addition-curable liquid silicone rubber being the base polymer, "150-01" being the needle-shaped fillers **4*b*1, and a water-containing gel were stirred at a rotation number of a stirring blade of 80 rpm for 30 minutes through use of a universal mixing and stirring machine (product name: T.K. HIVIS MIX Model 2P-1 manufactured by Primix Corporation) to prepare an emulsion-like liquid composition. In this case, the uncrosslinked addition-curable liquid silicone rubber and the needle-shaped fillers 4*b*1 were blended so that the content ratio of the needle-shaped fillers 4*b*1** was 4 vol % as shown in Table 1.

An electrophotographic rotatable pressing member No. D-01 was obtained under the same condition as that of Example A-1 except that, when the liquid composition prepared as described above was injected into the cavity 9 through the communication path 11, the cavity 9 was filled with the liquid composition under a state in which the cavity 9 was decompressed in advance through use of a decompressor (product name: VUH07-66A manufactured by Nihon Pisco Co., Ltd.) mounted at the end of the communication path 10. The elastic layer **4*b*** of the obtained electrophotographic rotatable pressing member No. D-01 had a hollow part ratio of 30 vol %.

The standard deviation of the area ratio $A_1/A_2$ was measured in the same manner as in Example A-1 through use of an electrophotographic rotatable pressing member obtained by the same manufacturing method as that for the electrophotographic rotatable pressing member No. D-01. Of the standard deviations, the maximum value was shown in Table 1 as the standard deviation of the electrophotographic rotatable pressing member No. D-01.

Comparative Example D-1

An electrophotographic rotatable pressing member No. D-02 was obtained under the same condition as that of Example D-1 except that substrate-holders having no groove 12 were used as the substrate-holders 5 and 6.

The standard deviation of the area ratio $A_1/A_2$ was measured in the same manner as in Example A-1 through use of an electrophotographic rotatable pressing member obtained by the same manufacturing method as that for the electrophotographic rotatable pressing member No. D-02. Of the standard deviations, the maximum value was shown in Table 1 as the standard deviation of the electrophotographic rotatable pressing member No. D-02.

It was confirmed that, in each of Comparative Examples, the liquid composition flowed at the time of heating and crosslinking and slightly leaked through a clearance between the O-ring 8 and the tubular mold 7 or between the O-ring 8 and the substrate-holder 5 or 6.

<<Evaluation of Electrophotographic Rotatable Pressing Member>>

The obtained electrophotographic rotatable pressing member was measured for hardness at the same positions as the six positions from which the samples were cut out for measuring the standard deviation of the area ratio $A_1/A_2$ through use of a hardness tester (product name: Durometer Type E, 1 kgf, manufactured by Kobunshi Keiki Co., Ltd.)

After that, the manufactured electrophotographic rotatable pressing member was mounted on the fixing device illustrated in FIG. 1 with a pressurizing force applied between the fixing member and the electrophotographic rotatable pressing member being 70 kgf.

Then, a severe durability test was performed through continuous sheet passage. After the passage of 100,000 sheets, the electrophotographic rotatable pressing member was removed from the fixing device, and the six positions measured for hardness before the severe durability test were similarly measured for hardness. Of the hardness change ratios after the severe durability test in the case of setting the hardness before the severe durability test at each of the six positions to 100%, the maximum hardness change ratio was shown in Table 1 as the hardness change ratio in the severe durability test.

The hardness change ratio was calculated by the following expression.

Hardness change ratio={(Hardness after severe durability test-Hardness before severe durability test)/Hardness before severe durability test}×100

The present invention has been described by means of exemplary embodiments so far. However, the present invention is not limited to those embodiments. The present invention can be modified and changed variously within the scope and the gist thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An electrophotographic rotatable pressing member, comprising:

a substrate; and an elastic layer on the substrate, the elastic layer containing a silicone rubber and a needle-shaped filler dispersed in the silicone rubber, and having hollow parts, wherein, when cutting the elastic layer along a cross section including a center axis of the substrate in a longitudinal direction of the electrophotographic rotatable pressing member, and a total of each sectional area of the hollow parts in a unit area $A_2$ of a cross-sectional surface is defined as $A_1$, a standard deviation of an area ratio $A_1/A_2$ is 0.08 or less.

2. The electrophotographic rotatable pressing member according to claim 1, wherein the elastic layer has a hollow part ratio of 20 vol % to 60 vol %.

3. The electrophotographic rotatable pressing member according to claim 2, wherein the hollow part ratio of the elastic layer is 40 vol % to 60 vol %.

4. The electrophotographic rotatable pressing member according to claim 1, wherein each of the hollow parts in the elastic layer has a diameter of 5 μm to 30 μm.

5. The electrophotographic rotatable pressing member according to claim 1, wherein the elastic layer contains the needle-shaped filler in a content ratio of 2 vol % to 15 vol %.

TABLE 1

| | Needle-shaped filler | Hollow part Vol % | Needle-shaped filler Vol % | Configuration of substrate-holders 5 and 6 | Decompression of cavity at time of cast molding | Standard deviation of area ratio $A_1/A_2$ | Hardness change ratio in severe durability test (%) |
|---|---|---|---|---|---|---|---|
| Example A-1 | 100-05M | 60 | 15 | Groove is present | Decompression is absent | 0.08 | 5.0 |
| Example A-2 | 100-05M | 60 | 15 | Groove is present | Decompression is present | 0.06 | 4.3 |
| Comparative Example A-1 | 100-05M | 60 | 15 | Groove is absent | Decompression is absent | 0.15 | 8.5 |
| Example B-1 | K223HM | 40 | 7 | Groove is present | Decompression is absent | 0.07 | 4.0 |
| Example B-2 | K223HM | 40 | 7 | Groove is present | Decompression is present | 0.05 | 3.3 |
| Comparative Example B-1 | K223HM | 40 | 7 | Groove is absent | Decompression is absent | 0.14 | 7.6 |
| Example C-1 | MLD-300 | 20 | 2 | Groove is present | Decompression is absent | 0.04 | 2.3 |
| Example C-2 | MLD-300 | 20 | 2 | Groove is present | Decompression is present | 0.02 | 0.9 |
| Comparative Example C-1 | MLD-300 | 20 | 2 | Groove is absent | Decompression is absent | 0.12 | 5.5 |
| Example D-1 | 150-01 | 30 | 4 | Groove is present | Decompression is present | 0.06 | 3.3 |
| Comparative Example D-1 | 150-01 | 30 | 4 | Groove is absent | Decompression is absent | 0.13 | 6.7 |

6. The electrophotographic rotatable pressing member according to claim 1, further comprising a surface layer on the elastic layer.

7. A fixing device, comprising:

an electrophotographic rotatable pressing member;

a heating member arranged so as to be opposed to the electrophotographic rotatable pressing member; and a heating unit of the heating member, wherein the electrophotographic rotatable pressing member comprises:

a substrate; and an elastic layer on the substrate, the elastic layer containing a silicone rubber and a needle-shaped filler dispersed in the silicone rubber, and having hollow parts, wherein, when cutting the elastic layer along a cross section including a center axis of the substrate in a longitudinal direction of the electrophotographic rotatable pressing member, and a total of each sectional area of the hollow parts in a unit area $A_2$ of a cross-sectional surface is defined as $A_1$, a standard deviation of an area ratio $A_1/A_2$ is 0.08 or less.

8. The fixing device according to claim 7, wherein the heating member includes a film having an endless belt shape, and wherein the heating unit includes a heater arranged so as to be brought into contact with an inner peripheral surface of the heating member.

* * * * *